United States Patent [19]

Harandi et al.

[11] Patent Number: 4,822,480

[45] Date of Patent: Apr. 18, 1989

[54] HYDROCARBON PRODUCT STRIPPING

[75] Inventors: Mohsen N. Harandi, Sewell; Hartley Owen, Belle Mead, both of N.J.; Michael T. Siuta, Yardley, Pa.

[73] Assignee: Mobil Oil Corporation, New York, N.Y.

[21] Appl. No.: 137,113

[22] Filed: Dec. 22, 1987

[51] Int. Cl.[4] ..... C10G 7/00

[52] U.S. Cl. ..... 208/212; 208/308; 208/347; 208/355; 208/356; 208/362

[58] Field of Search ..... 208/212, 308, 347, 355, 208/356, 362

[56] References Cited

U.S. PATENT DOCUMENTS 3,310,487 3/1967 Johnson et al. ..... 208/355
3,365,374 1/1968 Short et al. ..... 208/212
3,637,485 1/1972 Salka ..... 208/212
4,415,443 11/1983 Murphy ..... 208/356

FOREIGN PATENT DOCUMENTS 1272286 12/1986 Japan ..... 208/362

*Primary Examiner*—Asok Pal
*Attorney, Agent, or Firm*—Alexander J. McKillop; Charles J. Speciale; Malcolm D. Keen

[57] ABSTRACT

Improved product stripping in a catalytic hydrodesulfurization (CHD) product stream is obtained by employing off-gas from the unit as a stripping medium. The compressed off-gas is introduced into the stripper below the stripper feed level. The stripper may be operated at pressures higher than those previously employed in CHD product strippers and this permits LPG recovery to be maximized with lower product sulfur levels and reduced load in the off-gas compressor.

10 Claims, 4 Drawing Sheets

HYDROCARBON PRODUCT STRIPPING

FIELD OF THE INVENTION

This invention elates to an improved product stripper and more particularly to an improved product stripper for stripping petroleum fractions produced from catalytic hydrodesulfurization processes. The stripper provides improved separation of light gasiform components.

BACKGROUND OF THE INVENTION

Many petroleum crude oil and straight run fractions thereof contain one or more compounds of sulfur, nitrogen, heavy metals, halogen material and oxygen whose removal from the petroleum fractions is necessitated for reasons relating to refinery process operations, product quality or environmental considerations. Hydrotreating is one of the methods commonly used in the petroleum refining industry to remove many of these undesirable foreign elements. Sulfur is perhaps the most common of the contaminating elements in crude oil and is found in one form or another in almost all crude oils and straight run fractions. The removal of sulfur has long been necessary for producing products of acceptable quality and in more recent times has become even more important for improving our surrounding atmospere. Desulfurization processes are conventionally conducted by hydrogenation in the presence of a catalyst which promotes the conversion of sulfur impurities to hydrogen sulfide. In catalytic hydrodesulfurization processes, or CHD, high ratios of hydrogen to sulfur containing hydrocarbon charge are preferably maintained since a high hydrogen partial pressure in the reaction zone has a favorable influence on the efficiency of the desulfurization reaction and the life of the catalyst. Accordingly, the CHD reactor effluent stream is typically comprised of a substantial quantity of light gasiform components such as hydrogen, hydrogen sulfide and $C_2-$ hydrocarbons as well as distillate and gasoline fractions.

Separation of the inorganic sulfur from the rest of the CHD effluent stream is accomplished principally by fractination in a stripper but the composition of the streams has presented problems in the design and operation of an effective stripper. In particular, the presence of hydrogen sulfide and other acid gases must be taken into account in stripper design and operation in order to avoid serious corrosion problems in the stripper and the reboiler which is conventionally used to provide heated stripping vapor. In the presence of hydrogen sulfide the reboiler temperature is limited to a maximum value above which high corrosion may occur. Accordingly, the reboiler temperature limitation dictates a relatively low pressure operation of the stripper in order to create sufficient vapor at the stripper bottom stages to separate the components at the maximum allowable operating temperature. By limiting the stripper operation to relatively low pressures, the quality of the separation is compromised to the extent that valuable light hydrocarbons in the LPG range are carried over with gasiform components such as hydrogen and $C_2-$ into the CHD offgas stream.

In an alternative type of product stripper, the reboiler is eliminated and a relatively high temperature stripping medium is used, usually steam. This type of unit is, however, undesirable because dehydrating facilities are needed in order to dry the product.

Thus, the reboiler type stripper has the disadvantage that low pressure operation is dictated by the corrosion problems which would arise from the use of higher temperatures at the bottom of the stripper which would otherwise increase the availability of stripping vapors from the CHD effluent stream. On the other hand, the use of high temperature stripping media from external sources usualy requires additional equipment for separation of the stripping medium from the desulfurised product.

SUMMARY OF THE INVENTION

We have now devised a technique for the more effective separation of the light gasiform components in a hydrogenated hydrocarbon feed stream which is applicable to the operation of a CHD unit and which permits operation of a CHD process stripper at higher pressure without increased corrosion or coking and also enables the light gasiform components of a CHD effluent to the separated at lower compressor horsepower.

According to the present invention the separation of light gasiform components of a hydrocarbon stream is enhanced in the stripping process by introducing a stripping medium several stages below the hydrocarbon feed stage to the stripper.

According to the present invention, the off-gas from the CHD unit is used as the stripping medium after the inorganic sulfur content ($H_2S$) has been removed in the absorber. In order to provide the gas at sufficient pressure for stripper tower operation, the off-gas is taken off after the compressor and an appropriate pressure letdown valve may be provided for reduction to stripper tower pressure.

In the operation of the present CHD product stripping, the CHD effluent stream is separated in a stripping zone to provide a relatively lower boiling fraction containing sulfur impurity and a relatively higher boiling fraction. The lower boiling fraction is separated to provide a gas stream from which the sulfur impurity is removed and a minor portion of the purified gas stream is then passed to the stripping zone to strip and remove the sulfur impurity from the effluent stream. The higher boiling fraction is passed to a reboiler to provide the heat required in the stripping zone.

In conventional unit operation with high temperature and low temperature separators after the CHD reactor, the relatively low temperature liquid fraction from the low temperature stripper is introduced to an upper section of the product stripping zone at elevated pressure and the relatively high temperature liquid product fraction from the high temperature separator is passed to a middle section of the product stripping zone. The heavy hydrocarbon product is withdrawn from the bottom section of the stripping zone and a portion of it heated prior to being recycled to the lower section of the stripping zone. The stripping zone overhead stream comprising light gasiform components and vaporous unstabilized liquid gasoline is withdrawn, and separated with a liquid portion returned as a reflux stream to a top section of the stripping zone. The gasiform portion of the separated overhead stream is passed through an absorber in which the hydrogen sulfide is removed after which the gasiform effluent stream from the absorber is compressed and a portion of the compressed stream recycled as stripping gas to the stripping zone above the heavy hydrocarbon recycle stream inlet and below the low temperature petroleum fraction inlet. Under these stripping conditions an LGP-rich, unstabilized gasoline stream may be retrieved as product in addition to the heavy fraction from the bottom of the stripper.

The compressor horsepower requirements required to compress the gaseous effluent stream from the absorber comprising $C_2^-$ hydrocarbons stream are reduced compared to conventional stripper operations. The horsepower reduction is due to higher stripper operating pressure which reduces the compression ratio and the gas flow rate. If the CHD off-gas is sent to fuel gas the off-gas compressor can be eliminated by operating the stripper system at a higher pressure than the fuel gas main. In this case a small gas blower is required for recycling the stripping gas stream.

A CHD product stripping unit according to the present invention comprises a vertical stripping tower equipped with inlets to receive a liquid reflux stream in a top section, a relatively low temperature liquid petroleum fraction in a lower section, a relatively high temperature liquid petroleum stream in a yet lower section, a stripping gas recycle stream in a still lower section below the high temperature liquid inlet, and a bottoms reboil recycle stream inlet in a bottom section of the vessel. The vessel has outlets for withdrawing an overhead product and a bottoms product with a reboiler connected to the bottom outlet to heat a portion of the bottoms product and recycle that portion to the bottoms recycle (reboil) inlet. A separator is connected to the overhead product conduit to receive and separate the overhead product into gasiform and liquid product. An absorber is connected to the separator to receive the gasiform product and absorb hydrogen sulfide. A compressor is connected to the absorber to receive and compress the purified absorber effluent stream and a conduit is connected to the compressor outlet and to the stripping gas inlet to the stripping tower to recycle compressed stripping gas to the tower.

THE DRAWINGS

In the accompanying drawings:

FIG. 1 is a schematic diagram of a CHD process showing the interrelation of process units, FIG. 2 is a drawing of a CHD product stripper utilizing off-gas as stripping medium, FIG. 3 is a graph plotting product hydrogen sulfide content against a ratio of product stripping gas vapor to overhead accumulator vapor for a low pressure stripper, and FIG. 4 is a graph plotting product hydrogen sulfide content against the ratio of a stripping gas vapor to overhead accumulator vapor for a stripper using off-gas as the stripping medium.

DETAILED DESCRIPTION

Figure 1:
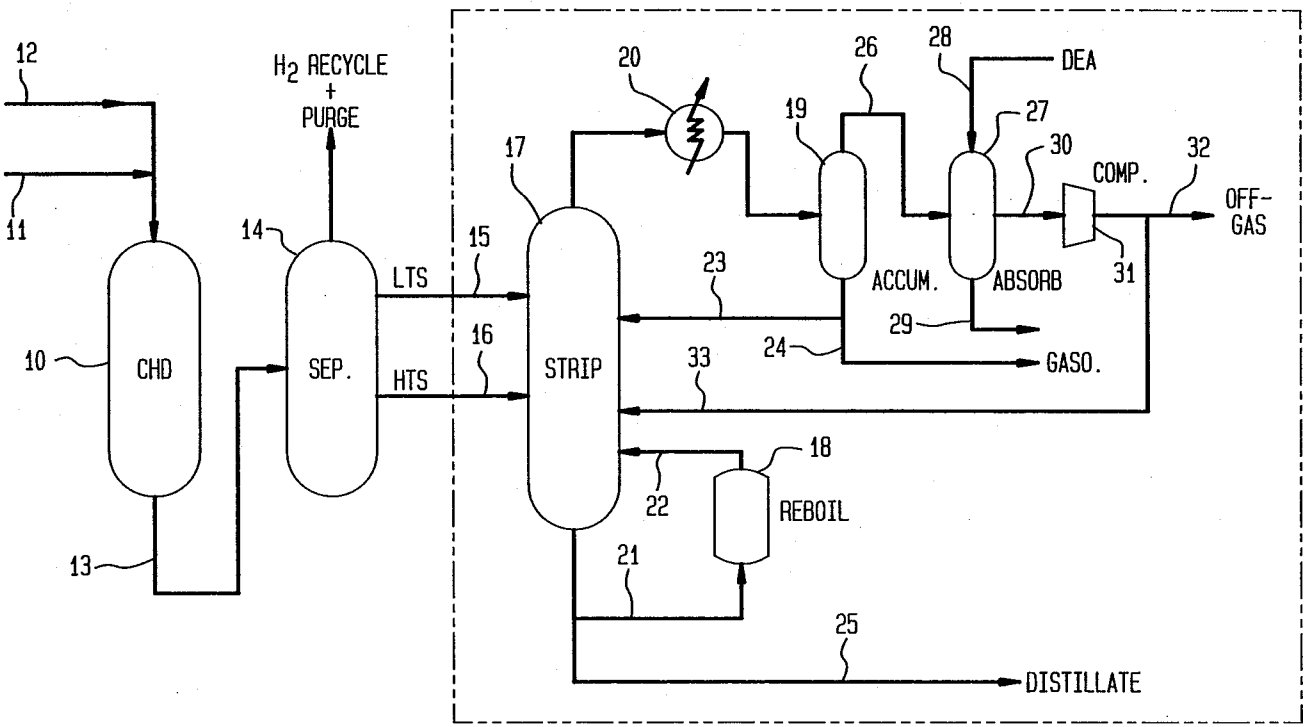

Referring to FIG. 1, a schematic diagram of a catalytic hydrodesulfurization process is illustrated. That portion of the CHD process of a particular relevance to the present invention is enclosedin dashed lines.

Hydrocarbon materials which may be successfully desulfurized in the process of the present invention include straight run hydrocarbons or hydrocarbon materials of cracking operations including kerosene, gas oil, cycle stocks from catalytic cracking or thermal cracking operations, residual oils, thermal and coker distillates. Sulfur concentrations of these hydrocarbons may vary from about 0.05 to about 10 weight percent or higher. Heavy hydrocarbon stocks, i.e., having an API gravity lower than about 20, may also be employed as feedstock to the hydrodesulfurization process.

Catalyst materials which may be successfully employed in the desulfurization of hydrocarbon material include those catalysts known to have significant hydrogenation activity which promote the conversion of organic sulfur to form inorganic sulfur (hydrogen sulfide), which is removed from the desulfurized product. Catalysts suitable for the purpose generally comprises a transition metal component, usually a base metal such as nickel, cobalt or molybdenum or combinations such as cobalt-molybdenum or nickel-molybdenum on a porous inorganic support such as silica, alumina or silica-alumina. Hydrotreating catalysts of this type are widely available commercially.

The hydrogen employed in catalytic hydrodesulfurization may be pure hydrogen or a hydrogen rich stream derived from a refinery process e.g. reforming. Also, the hydrogen rich stream derived from the separation of catalyst hydrodesulfurization off-gasses may be recycled to the desulfurization unit.

In FIG. 1, in a simplified flow schematic presentation, a hydrocarbon feed stream 11 and a hydrogen feed stream 12 are passed to a catalytic hydrodesulfurization unit 10 where the feed is desulfurised in the presence of a hydrotreating catalyst. The desulfurization effluent stream after cooling is passed in line 13 to a separator unit 14 and a relatively low temperature liquid hydrocarbon stream in line 15 and relatively high temperature liquid hydrocarbon stream in line 16 are separated in the respective LT and HT separators in unit 14 in the conventional manner. The liquid hydrocarbon streams are passed to a fractionator/stripper 17 equipped with a bottom reboiler 18 and an overhead accumulator 19. The stripper hydrocarbon bottoms fraction circulates in line 21 to the reboiler 18 for heating and then is recycled in line 22 to the bottom portion of the stripper. The stripper overhead fraction is cooled in heat exchanger 20 and passed to accumulator 19. A liquid fraction from the accumulator comprising unstabilized gasoline is withdrawn and a portion recycled in line 23 to stripper 17 as reflux liquid while a second portion is withdrawn through line 24 as unstabilized gasoline product. A heavier hydrocarbon or distillate product is withdrawn 25 from the bottom portion of the stripper. A gasiform material is withdrawn through line 26 from overhead accumulator 19 and passed to absorber 27 where it is contacted with an absorbent stream, typically diethylamine (DEA), circulaed through the absorber through lines 28 and 29, to remove hydrogen sulfide from the gasiform stream. The absorber effluent is passed in line 30 to compressor 31 and the pressure of the gasiform material, mainly hydrogen and $C_{22}^-$ hydrocarbons, elevated to between 200 and 280 psig, preferably about 265 psig if the off-gas is sent to gas plant for LGP recovery. While a portion of the gasiform compressor effluent is passed in line 32 as CHD offga for fuel or further separation, a second portion is recycled in line 33 to the stripper as stripping gas. The stripping gas may also be an external stream such as steam, high pressure CHD hydrogen purge or nitrogen.

If the CHD off-gas is sent to fuel the product stripper is at high enough pressures the need for off-gas compression to the fuel gas main pressure is eliminated. In this case, a small blower is required to recycle the stripping gas, with a typical blower differential pressure of about 5–15 psi.

Figure 2:
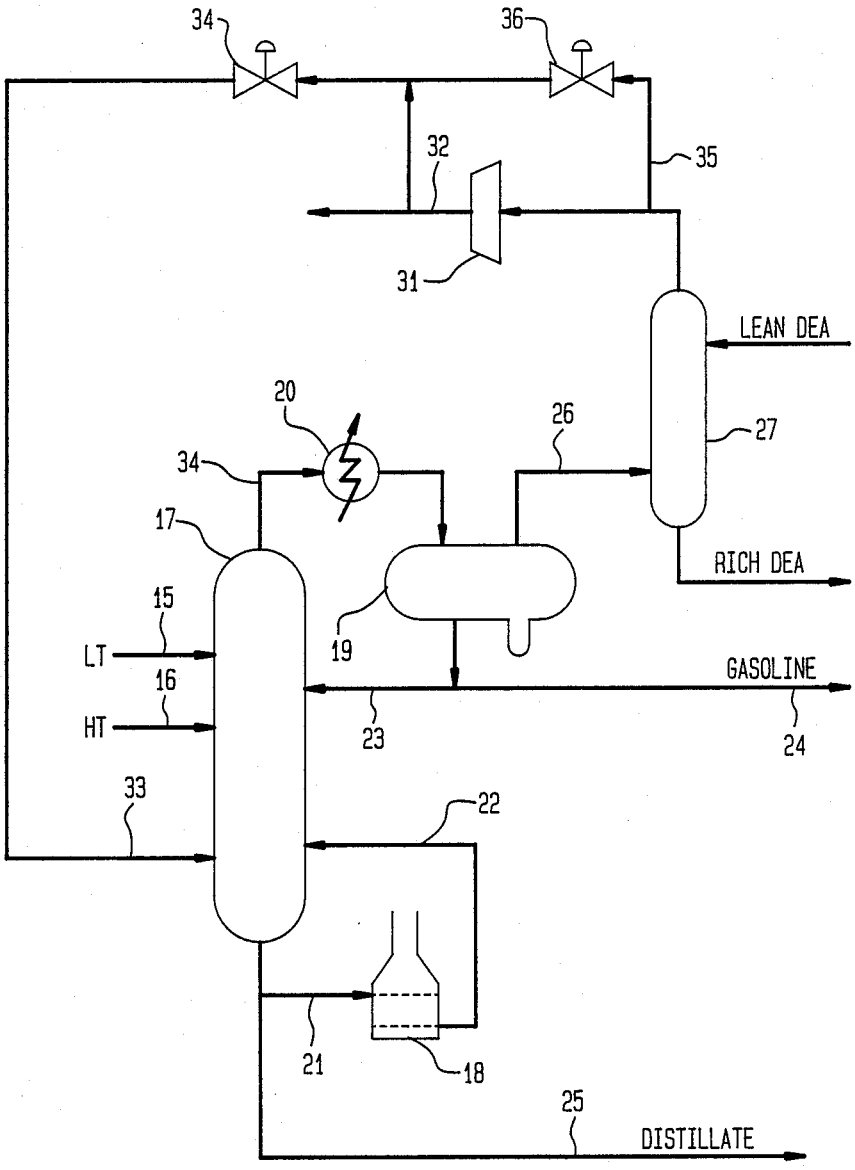

Referring now to FIG. 2, a more detailed diagram of the stripper is presented, encompassing that portion of the general schematic in FIG. 1 enclosed within dashed lines. In FIG. 2, overhead stream in line 34 comprising a mixture of gasiform materials and vaporous, unstabilized gasoline is withdrawn from an outlet at the top of the stripper tower 17, cooled in heat exchanger 20, and passed to accumulator 19 where the liquid is separated and a portion of the separated liquid returned to the stripper through conduit 23 at an inlet level in the top section of the stripper tower 17 below the overhead outlet. Low temperature liquid feedstream in line 15 is introduced into the upper section of the stripper at a level below the reflux liquid inlet from line 23. The relatively high temperature (HT) liquid stream in line 16 is introduced into the middle section of the stripper at a level below the inlet of the relatively low temperature (LT) liquid stream in line 15. Stripping medium in line 33 is introduced into the stripper tower at a level in a lower section of the stripper below the inlet of the relatively high temperature liquid in line 16. The reboiler recycle stream 22 is introduced into the lower secion of the stripper at a level below the inlet of the stripping stream in line 33. The heavy hydrocarbon bottoms are withdrawn through conduit 25 from the bottom section of the stripper and a portion of the heavy hydrocarbon distillate products is fed to stripper reboiler 18 through conduit 21 to heat the heavy hydrocarbon product for recycle through conduit 22 to the stripper to provide the requisite heat and temperature gradient to the tower.

Relative to the conventional CHD design the composition of the gasiform stream leaving the overhead accumulator 19 through conduit 26 to absorber 27 is lean in LPG range hydrocarbons ($C_3$+), while the liquid product separated from the accumulator as unstabilized gasoline through conduit 24 in rich LPG range ($C_3$+) hydrocarbon materials. After absorption of hydrogen sulfide in absorber 27, the composition of stream entering compressor 31 comprises a hydrogen-rich stream of $C_2$− hydrocarbons. Accordingly, in comparison with a conventional stream which typically contains more LPG and gasoline range hydrocarbons, the compressor load is substantially reduced. This reduction in hydrocarbon loss to the off-gas is achieved by the use of the off-gas as the stripping medium in combination with the reboiler which permits improved stripping without increasing the reboiler temperature to a level where corrosion would become a problem. Typically the temperature at the bottom of the tower at the reboiler inlet from line 22 will be from 580° to 650° F., more usually from 600° to 650° F.

The recycled stripping gas is obtained from the compressor outlet stream of CHD offgas. The stripping stream is recycled to the stripper tower through pressure control valve 34 while a portion of the offgas is recycled as compressor spillback gas through control valve 36 and conduit 35.

The stripper tower may be operated at higher pressure than is conventional for reboiler type stripper units. As described above, the reboiler temperature limitation in a conventional unit dictates relatively low pressure operation of the stripper in order to create enough vapor at the maximum allowable operating temperature at the stripper bottom stages for stripping the undesired components. The present stripper, however, provides an additional means for stripping the undesired components and this allows the stripper to be operated at a relatively higher pressure so as to maximize LPG ($C_3$+) recovery and minimize the off-gas compressor load. In this way, the stripper can be operated at a pressure between 30–150 psig, preferably about 80 psig. The reboiler temperature may be between about 580° and 660° F., preferably about 640° F.

Figure 3:
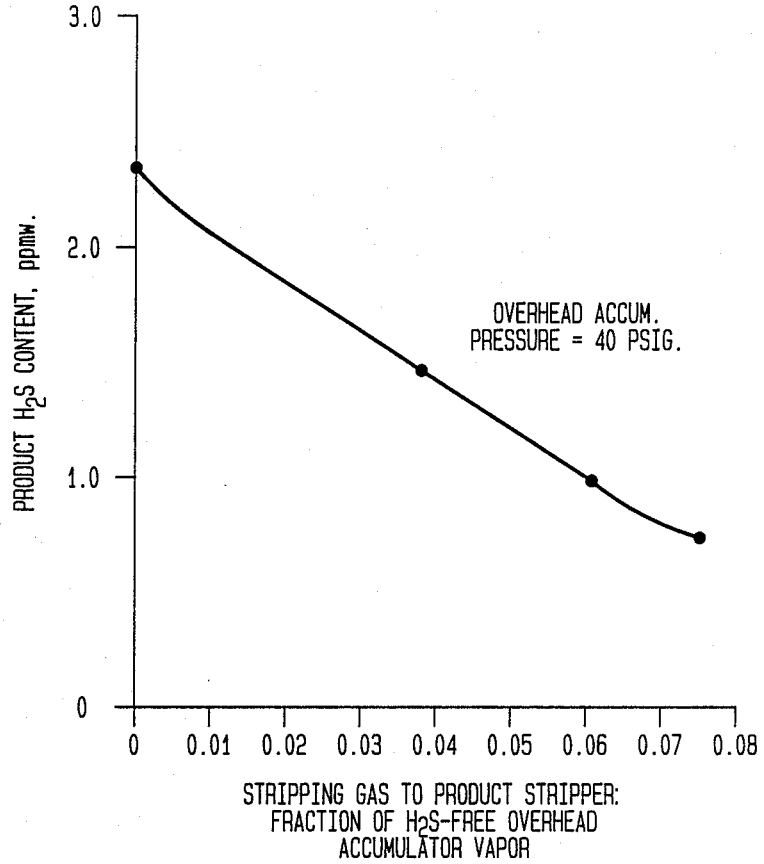
Figure 4:
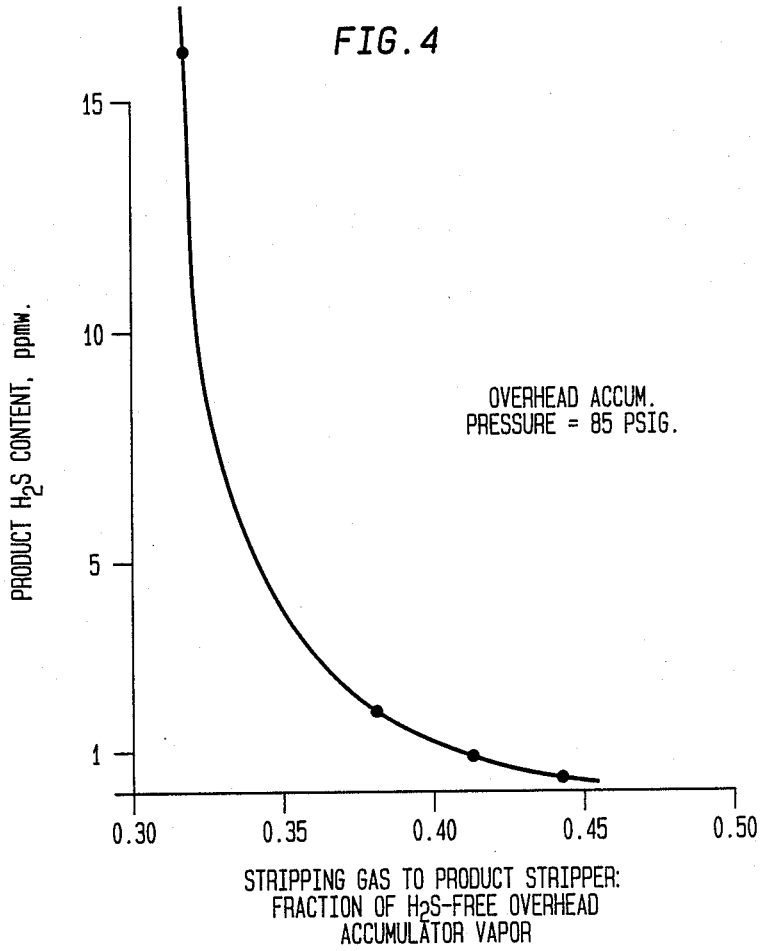

Higher pressure operations using stripping gas recycle, allows for a substantial increase in the ratio of stripping gas vapor to overhead accumulator vapor with highly beneficial results on the removal of hydrogen sulfide. In the present invention the volumetric ratio of stripping gas vapor to overhead accumulator vapor may be between 0.05 and 0.6, preferably about 0.4. Referring to FIG. 3 and to FIG. 4 the results are plotted of the operation of a stripper under different operating regimes. FIG. 3 shows the relationship between product $H_2S$ content and the stripping gas to the stripper at a conventional overhead accumulator pressure of 40 psig. FIG. 4 shows that when off-gas is recycled to the stripper as in the present process, the stripper can operate at much higher pressures (here, 85 psig) and still meet a limit of 1 ppm $H_2S$ for the product.

A further comparison is provided in Table 1 below. In Table 1, a comparison is presented of the operating conditions and the performance of a refinery unit utilizing a CHD process incorporating a recycled off-gas stripper with a refinery unit utilizing a CHD process incorporating conventional product stripper design without stripping gas recycle to the product stripper. Column A presents data on the conventional unit and Column B presents data on the unit incorporating the recycled off-gas/reboiler stripper.

From Table 1 it can be seen that at constant reboiler duty, with the same number of stripper trays and hydrogen sulfide content of the product, the following advantages are achieved: reduced stripper diameter by 23 percent; reduced off-gas make by 13 percent; reduced compressor horsepower requirements by 23 percent, assuming the offgas is compressed to the gas plant pressure; reduced stripper reboiler outlet temperature.

TABLE 1

| CHD Product Stripper Design | No Recycle A | Recycle B |
|---|---|---|
| Product $H_2S$ Content, PPMW | 1.0 | 1.0 |
| Ovhd. Acc. Pressure, psig | 40 | 85 |
| Ovhd. Acc. Temperature, °F. | 90 | 90 |
| Ovhd. Condenser duty, MMBTU/Hr. | 8.0 | 7.4 |
| Bottoms Temperature, °F. | 585 | 582 |
| Reboiler duty, MMBTU/Hr. | 42.6 | 42.6 |
| Stripping Gas flow rate, MMSCFD | 0 | 2.05 |
| Compressor Discharge Pressure, psig | 212 | 212 |
| Compressor Power, hp | 368 | 285 |
| Stripper Diameter, ft. | 13.5 | 10 |
| No. of Theoretical Stages | 16 | 16 |
| Off-Gas Rate, MMSCFD | 3.36 | 2.91 |
| Unstabilized Gasoline Rate, BPSD | 1,100 | 1,100 |
| Distillate Product Rate, BPSD | 56,871 | 57,127 |
| Distillate Flash Point, °F. | 178 | 169 |

We claim:

1. A method for stripping light gasiform components from the liquid effluent of a catalytic hydrodesulfurization process, which comprises:

(i) separating the liquid effluent containing relatively low boiling hydrocarbon components, relatively high boiling hydrocarbon components, hydrogen and hydrogen sulfide in a stripping/fractionation zone to form an overhead fraction comprising low boiling components, hydrogen and hydrogen sulfide and a bottoms fraction comprising high boiling components, (ii) heating a portion of the bottoms fraction and returning the heated fraction to the stripping fractionation zone, (iii) separating relatively low boiling hydrocarbons from the overhead fraction to form a gaseous stream containing hydrogen sulfide, (iv) removing hydrogen sulfide from the gaseous stream, (v) passing a portion of the gaseous stream from which the hydrogen sulfide has been removed to the stripping zone, (vi) stripping the effluent with the portion of the gaseous stream passed to the stripping zone to strip relatively low boiling hydrocrbon components and hydrogen sulfide from the effluent.

2. A method according to claim 1 in which the gaseous stream is compressed after removal of the hydrogen sulfide and before being passed to the stripping zone.

3. A method accoring to claim 1 in which the portion of the gaseous stream passed to the stripping zone is passed into the stripping zone at a lower level than the liquid effluent from the hydrodesulfurization unit.

4. A method according to claim 3 in which the liquid effluent from the hydrodesulfurization unit comprises a relatively high temperature effluent stream and a relatively low temperature effluent stream, both which are passed into the stripping zone above the off-gas.

5. A method according to claim 1 in which the portion of the gaseous stream passed to the stripping zone comprises hydrogen and $C_2^-$ hydrocarbons.

6. A hydrocarbon product stripping method for the improved separation of light gasiform components from liquid petroleum product fractions from a catalytic hydrodesulfurization process, comprising the steps of:

(i) passing a relatively low temperature liquid petroleum product fraction feedstream to an upper section of a product stripping zone, (ii) passing a relatively high temperature liquid petroleum product fraction feedstream to a middle section of the product stripping zone;

(iii) withdrawing a heavy hydrocarbon product from the bottom section of the stripping zone and heating a portion of the withdrawn fraction, (iv) recycling the heated portion of the withdrawn product to a lower section of the stripping zone;

(v) withdrawing an overhead stream comprising light gasiform components and vaporous unstabilized liquid gasoline from the stripping zone, (vi) cooling the overhead stream and separating a liquid portion of it, (vii) returning a portion of the separated liquid portion to the stripping zone as reflux, (viii) passing the gasiform portion of the separated overhead stream through an absorber to remove hydrogen sulfide and to form a gasiform effluent, (ix) compressing the gasiform effluent from the absorber, and (x) recycling a portion of the compressed effluent as stripping gas to a lower section of the stripping zone above the heavy hydrocarbon recycle stream inlet and below the high temperature petroleum product fraction feedstream inlet under stripping conditions to strip $H_2S$ effectively from the heavy hydrocarbon fraction.

7. A method according to claim 6 in which the stripping zone stripping conditions comprise pressure between 30 and 150 psig.

8. A method according to claim 7 in which the stripping zone stripping conditions comprise pressure about 80 psig.

9. A method according to claim 6 in which the stripping zone stripping conditions further comprise a bottom section temperature between about 550° and 650° F. and a volumetric ratio of stripping gas stream vapor to overhead stream between 0.05 and 0.6.

10. A method according to claim 6 in which the stripping zone stripping conditions further comprise a bottom section temperature about 550° to 600° F. and a volumetric ratio of stripping gas stream vapor to $H_2S$ free overhead accumulator vapor about 0.35 to 0.45.

* * * * *